United States Patent [19]

Gartland

[11] Patent Number: 4,986,333

[45] Date of Patent: Jan. 22, 1991

[54] METHOD OF SUPPORTING A CORE IN A MOLD

[75] Inventor: Frederick H. Gartland, Nottingham, England

[73] Assignee: Rolls-Royce, Plc, London, England

[21] Appl. No.: 295,368

[22] Filed: Jan. 10, 1989

[30] Foreign Application Priority Data

Jan. 13, 1988 [GB] United Kingdom ..... 8800686

[51] Int. Cl.[5] ..... B22C 9/04; B22C 9/10

[52] U.S. Cl. ..... 164/30; 164/35; 164/137

[58] Field of Search ..... 164/30, 31, 32, 34, 164/35, 366, 397, 398, 137

[56] References Cited

U.S. PATENT DOCUMENTS 3,596,703 8/1971 Bishop et al. ..... 164/30 X 3,598,167 8/1971 Snyderman ..... 164/35 X 3,659,645 5/1972 Rose ..... 164/366 X

FOREIGN PATENT DOCUMENTS 60-45979 10/1985 Japan ..... 164/35

*Primary Examiner*—Nicholas P. Godici

*Assistant Examiner*—J. Reed Batten, Jr.

*Attorney, Agent, or Firm*—Cushman, Darby & Cushman

[57] ABSTRACT

The ceramic core is located within the ceramic mold by the insertion of recrystallized alumina pins through the wax encasing the core prior to encasing the whole in a ceramic slurry; on the subsequent removal of the wax, the molten metal, i.e. superalloy, is injected into the resulting space; the recrystallized alumina pins remain intact during the casting process hence substantially increasing the success rate of achieving accurate core locating during casting solidification.

5 Claims, 1 Drawing Sheet

METHOD OF SUPPORTING A CORE IN A MOLD

BACKGROUND OF THE INVENTION

This invention relates to an improved method of locating and supporting a ceramic core in fixed space relationship in a ceramic shell mold and maintaining this fixed space relationship in the subsequent casting process for production of a hollow metal casting.

In the investment casting i.e. the "lost-wax" process for the production of hollow metal castings, it is known to encase a core in wax through which platinum pins are inserted until the pins are in contact with the core, prior to coating the wax encased core with a shell of ceramic slurry, so that on hardening the shell and thereafter removing the wax, the core remains supported in a fixed space relationship with the shell.

Disadvantages of this known method of core support that the pins, (a) are manufactured from platinum which whilst being inert with many materials, is expensive, (b) the platinum pins melt on casting the metal and dissipate into the casting during solidification. The now unsupported core may move from its precise location, (c) the platinum pins whilst sometimes supporting core lengths up to 12.5 cms, are unable to adequately support longer core lengths, resulting in the need for use of the known process of "core printing", whereby the core is extended to provide flattened ends which may then be gripped in the wax pattern die prior to encasing the core with wax. The core length is extended sufficiently so that after encasing the core with wax and then removing the wax pattern die prior to coating the wax encased core with a ceramic slurry material to form the shell, the core prints protrude through the ceramic shell. The core printing method has the disadvantage that on subsequent removal of the core from the casting, manufacturing steps have to be added to blank off an aperture which the core printing causes to be produced at the blade tip.

SUMMARY OF THE INVENTION

The present invention seeks to provide an improved method of supporting a core within a shell mold during the investment casting process.

According to the present invention there is provided a method of locating and maintaining a wax encased core in fixed space relationship with the interior of a ceramic shell mold, comprising the steps of inserting a plurality of pins through the wax until said pins abut the core, and thereafter encasing the whole in a ceramic slurry, hardening the slurry so as to fix the pins and thereby maintaining support of the core on the removal of the wax and in the casting process, the pins being formed from a material which remains intact during the casting and subsequent solidification processes for production of hollow metal components.

Preferably the pins are of recrystallized alumina.

BRIEF DESCRIPTION OF THE DRAWING

The invention will now be described by way of example and with reference to the accompanying drawing of FIG. 1 which illustrates a schematic cross-sectional view of a mold used in the present invention.

DESCRIPTION OF THE PREFERRED EMBODIMENT

Figure 1:
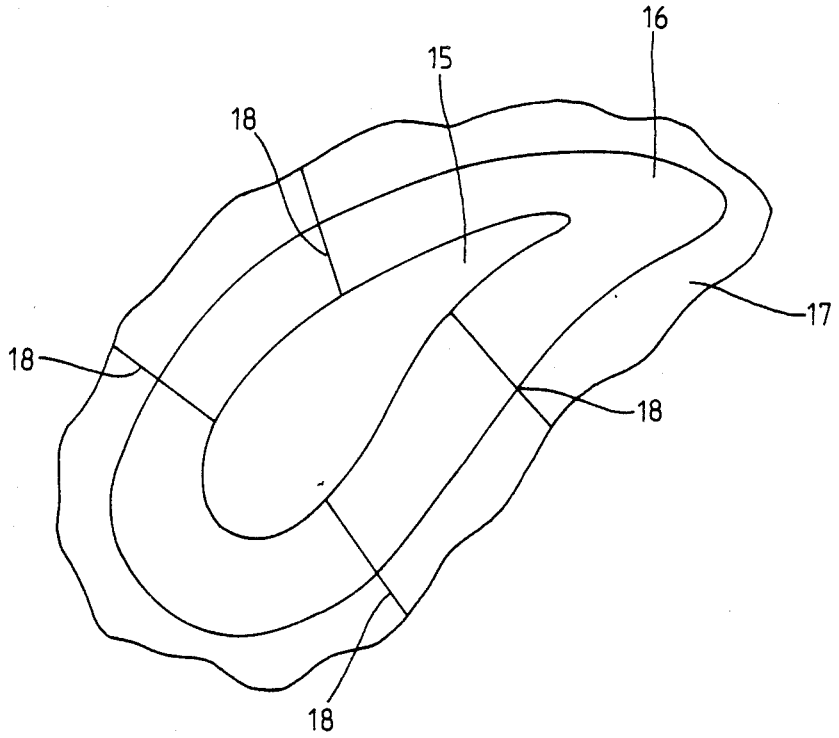

Referring to the drawing. A ceramic core (15) is encased with wax (16). Recrystallized alumina pins (18) are then inserted through the wax encasing the core until they abut said core (15) prior to encasing the whole in a ceramic slurry. The ceramic shell (17) is then hardened whereafter the wax (16) is melted and runs out, leaving the ceramic core (15) supported in space of relationship to the interior of the ceramic shell (17) by the recrystallized alumina pins (18). A molten metal e.g. a superalloy such as nickel/chrome, is then introduced into the shell to replace the lost wax. The recrystallized alumina pins remain intact during the casting process and thus maintain the accurate locations of the core during solidification of the metal.

On completion of the casting process the ceramic core and outer shell are removed chemically. Mechanical machining processes such as friction polishing then remove any surface defects caused by the recrystallized alumina joins and any other defects which may have been introduced at any of the various stages of the casting process.

Articles produced by the method of the present invention include nozzle guide vane and turbine blades for use in a gas turbine aeroengine. During operation of the turbine blades so produced it has been found that those portions of the recrystallized alumina pins which are embedded therein, tend to exit the blade under centrifugal forces and leave small apertures through the blade. This however does not adversely affect the cooling flow efficiency of the air flowing through the blade.

I claim:

1. A method of locating and maintaining a core in fixed space relationship with the interior of a ceramic shell mold in the investment casting process for making a cast component, comprising the steps of:

encasing the core in wax, inserting a plurality of recrystallized alumina pins through the wax encasing the core until said pins abut the core, encasing the wax encased core in a ceramic slurry and hardening the slurry to form a ceramic shell mold and to fix the recrystallized alumina pins, the fixed recrystallized alumina pins remaining intact during subsequent casting and solidification processes, thereby maintaining the core in an accurate location within the ceramic shell mold during the casting and solidification processes.

2. The method as claimed in claim 1 in which the cast component is a superalloy turbine blade which has a passageway therein.

3. The method as claimed in claim 1 in which the cast component is a superalloy nozzle guide vane which has a passageway therein.

4. The method as claimed in claim 2 in which the superalloy is a nickel/chrome alloy.

5. The method as claimed in claim 4 in which the superalloy is a nickel/chrome alloy.

* * * * *

UNITED STATES PATENT AND TRADEMARK OFFICE

CERTIFICATE OF CORRECTION

PATENT NO. : 4,986,333

DATED : Jan. 22, 1991

INVENTOR(S) : Frederick Hodgson GARTLAND

It is certified that error appears in the above-identified patent and that said Letters Patent is hereby corrected as shown below:

Column 2:

Claim 5, line 1, delete "4" and insert therefor --3--.

Signed and Sealed this

Twenty-ninth Day of September, 1992

*Attest:*

DOUGLAS B. COMER

*Attesting Officer*

*Acting Commissioner of Patents and Trademarks*